US006208591B1

(12) United States Patent
Sakurazawa et al.

(10) Patent No.: US 6,208,591 B1
(45) Date of Patent: Mar. 27, 2001

(54) LUMINESCENT DEVICE, TIMEPIECE, ELECTRONIC APPARATUS AND METHOD FOR MANUFACTURING LUMINESCENT DEVICE

(75) Inventors: Naohiko Sakurazawa, Hamura; Shunji Minami, Fussa; Hiroyuki Sonoda, Ome, all of (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/152,410

(22) Filed: Sep. 14, 1998

(30) Foreign Application Priority Data

Sep. 19, 1997 (JP) ..... 9-255438

(51) Int. Cl.[7] ..... G04B 19/30; G04B 19/32; H01J 1/62; H05B 33/10

(52) U.S. Cl. ..... 368/67; 226/227; 226/234; 313/110; 313/510; 362/23

(58) Field of Search ..... 368/67, 88, 223–237; 313/110–113, 506–510; 445/23, 24

(56) References Cited

U.S. PATENT DOCUMENTS 4,583,866 * 4/1986 Kasai et al. ..... 368/232
4,775,964 10/1988 Alessio et al. .
5,265,071 * 11/1993 Thorgersen et al. ..... 368/67
5,513,153 * 4/1996 Thorgersen et al. ..... 368/227
5,734,627 * 3/1998 Sy ..... 368/67
5,838,644 * 11/1998 Yoneda et al. ..... 368/232

* cited by examiner

*Primary Examiner*—Vit Miska
(74) *Attorney, Agent, or Firm*—Frishauf, Holtz, Goodman, Langer & Chick, P.C.

(57) ABSTRACT

A translucent or transparent panel member which has a protrusion on the upper surface thereof is disposed on the upper surface of a plate-like luminescent member, to form a luminescent device. The luminescent device is manufactured by forming a protrusion on the upper surface of the panel member, providing a masking layer on the peripheral side surface and the upper surface, of the protrusion, forming a printed layer on the upper surface of the panel member, forming a printed layer on the upper surface of the protrusion after removing the masking layer from the protrusions, and arranging the panel member on the upper surface of the plate-like luminescent member. Such a plate-like luminescent device is arranged in the timepiece case to illuminate the analog hand mechanism. Such a plate-like luminescent device is also arranged in an electronic apparatus case to illuminate a liquid crystal display device of the electronic apparatus.

13 Claims, 10 Drawing Sheets

LUMINESCENT DEVICE, TIMEPIECE, ELECTRONIC APPARATUS AND METHOD FOR MANUFACTURING LUMINESCENT DEVICE

BACKGROUND OF THE INVENTION

The present invention relates to a luminescent device which is useful for applying to various types of electronic apparatuses, e.g., an electronic watch, an electronic pocket notebook, a personal computer, and the like; a watch and an electronic apparatus, which have such a luminescent device; and a method for manufacturing such a luminescent device.

An Electro Luminescence element (hereinafter, which may be called "EL luminescent member") is a plate-like luminescent member, from the whole surface of which luminescence are emitted by an applied voltage.

The EL luminescent member, recently, is used in various types of electronic apparatuses, e.g., a watch, an electronic pocket notebook and the like. Because the EL luminescent member does not generate heat and the amount of electric power consumed thereby is small, the EL luminescent member has been applied to such types of apparatuses widely.

An example of a conventional watch having an EL luminescent member will be explained briefly in the following.

In case of the conventional watch having the EL luminescent member, a mechanism for driving analog hands is provided in an inner space between a watch glass which is disposed in an upper part of a watch case and a back cover which is disposed in a lower part of the watch case, namely, in the inside of the watch case.

The analog hands mechanism comprises a shaft for hands which extends from the center of the analog hands mechanism upwardly. Hands comprising a minute hand and an hour hand are connected with the shaft for hands.

A dial and a plate-like EL luminescent member in a layered state are placed on the upper surface of the analog hands mechanism. The periphery of the dial and the plate-like EL luminescent member are pressed down by a pressing member, thereby the dial and EL luminescent member are fixed to the watch case.

The dial is made of a translucent film or a light-transmissive color film, on the upper surface of which marks such as time indices or the like are printed.

The EL luminescent member emits light from the entirety of the surface thereof by an electric power or a voltage, for luminescence, which is supplied from a power source provided on a circuit board which is incorporated in the analog hands mechanism. Thereby, the EL luminescent member illuminates the whole dial and the whole hands of the analog hands mechanism, which are provided at an upper position to the EL luminescent member.

Therefore, the present time can be read even at night or in the dark from the outside through the dial and the hands illuminated by the EL luminescent member.

According to the conventional structure as described above, because the dial and the like are illuminated by the EL luminescent member, the dial must be made of a material through which light from the EL luminescent member can be transmitted.

Therefore, a translucent film or a light-transmissive color film are generally used for the dial. As a result, the entirety of the dial becomes light by the luminescence from the EL luminescent member to enable reading the time indices and the hands.

Conventionally, because the dial has a film on the surface thereof, it can give no metallic feeling, and therefore there are the problems to be solved, of being uninteresting and no feeling of high quality.

SUMMARY OF THE INVENTION

The present invention is accomplished in consideration of the conventional problems as described above.

Therefore, an object of the present invention is to provide a luminescent device which gives an interesting appearance and a feeling of high quality, and to provide a watch and an apparatus, which have such a luminescent device.

Another object of the present invention is to provide a method for manufacturing a luminescent device which gives an interesting appearance and a feeling of high quality.

In order to accomplish such objects, the present invention has the following features.

In accordance with one aspect of the present invention, the luminescent device comprises; a plate-like luminescent member, a translucent or transparent panel member which is disposed on an upper surface of the plate-like luminescent member, and a protrusion formed on an upper surface of the panel member.

In accordance with another aspect of the present invention, the luminescent device comprises; a plate-like luminescent member, a translucent or transparent protrusion member which is disposed on an upper surface of the plate-like luminescent member, a metallic panel which is disposed on an upper surface of the plate-like luminescent member except the protrusion member, and a printed layer or a metallic layer, which is formed on an upper surface of the protrusion member projecting from an upper surface of the metallic panel, except a peripheral side surface of the protrusion member.

In accordance with another aspect of the present invention, the timepiece comprises; a luminescent device as claimed in claim 1, and a timepiece case containing an analog hand mechanism having hands, therein, wherein the luminescent device is arranged in the timepiece case to illuminate the analog hand mechanism.

In accordance with another aspect of the present invention, the method for manufacturing a luminescent device, comprises: method for manufacturing a luminescent device, comprising: a first step for forming a protrusion on an upper surface of a translucent or transparent panel member; a second step for providing a masking layer on a peripheral side surface and an upper surface, of the protrusion; a third step for forming a printed layer on an upper surface of the panel member except on the peripheral side surface and the upper surface of the protrusion, which have the masking layer; a fourth step for forming a printed layer on the upper surface of the protrusion, after removing the masking layer from the protrusions; and a fifth step for arranging a plate-like luminescent member on a lower surface of the panel member to which the fourth step was carried out, to manufacture the luminescent device.

BRIEF DESCRIPTION OF THE DRAWINGS

FIGS. 3A and 3B show construction examples of a dial in the watch shown in FIG. 1, wherein FIG. 3A is a plan view of the dial using stick-like indices as the protrusions for representing hour indices, and FIG. 3B is a plan view of the dial using indices of numerals as the protrusions for representing hour indices;

FIGS. 10A to 10E are for explaining the method for manufacturing the luminescent device which is shown in FIGS. 8 and 9, in order, wherein FIG. 10A is a sectional view showing a first step for forming the protrusions, FIG. 10B is a sectional view showing a second step for providing a masking layer, FIG. 10C is a sectional view showing a third step for printing, FIG. 10D is a sectional view showing a fourth step for removing the provided masking layer, and FIG. 10E is a sectional view showing a fifth step for printing;

FIGS. 13A to 13D are for explaining the method for manufacturing the luminescent device which is shown in FIG. 12, in order, wherein FIG. 13A is a sectional view showing a first step for forming the protrusions, FIG. 13B is a sectional view showing a second step for providing a masking layer, FIG. 13C is a sectional view showing a third step for vapor deposition, and FIG. 13D is a sectional view showing a fourth step for removing the provided masking layer;

FIGS. 15A to 15C are for explaining the method for manufacturing the luminescent device which is shown in FIG. 14, in order, wherein FIG. 15A is an exploded sectional view showing a first step for forming a hole in the dial and for forming a protrusion member, FIG. 15B is a sectional view showing a second step for decorating the dial and the protrusion member, and FIG. 15C is a sectional view showing a third step for setting the protrusion member in the hole in the dial.

DESCRIPTION OF THE PREFERRED EMBODIMENT

Each embodiment of a luminescent device, a timepiece, an electronic apparatus, and a method for manufacturing the luminescent device, according to the present invention will be explained with reference to FIGS. 1 to 15C, as follows.

First Embodiment

Figure 1:
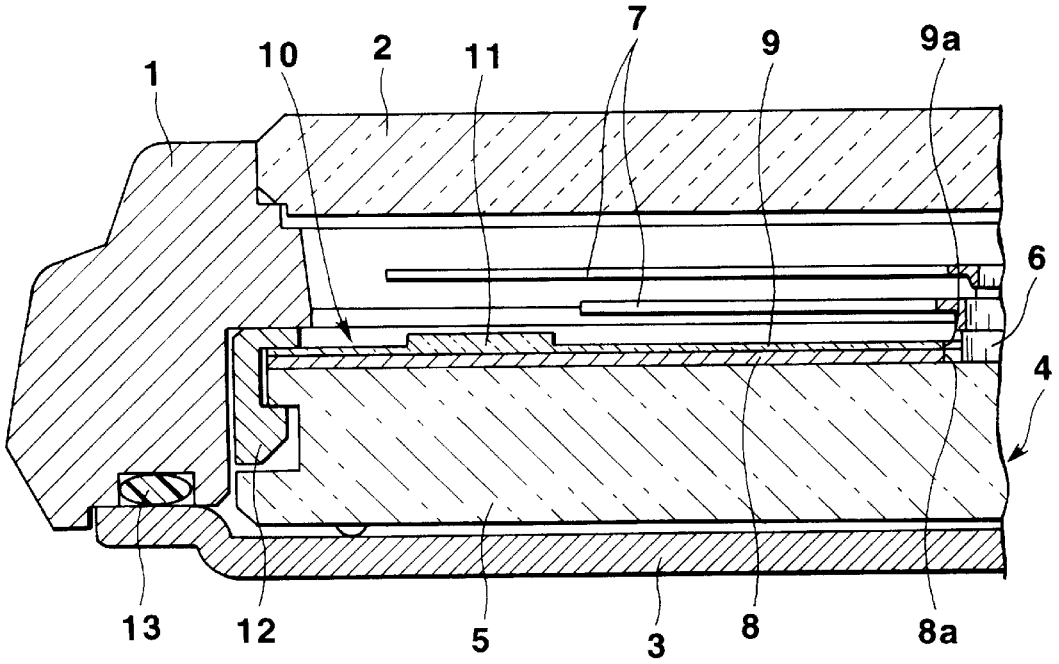
FIG. 1 is a vertical sectional view showing a schematic structure of a watch according to a first embodiment of the present invention.
Figure 2:
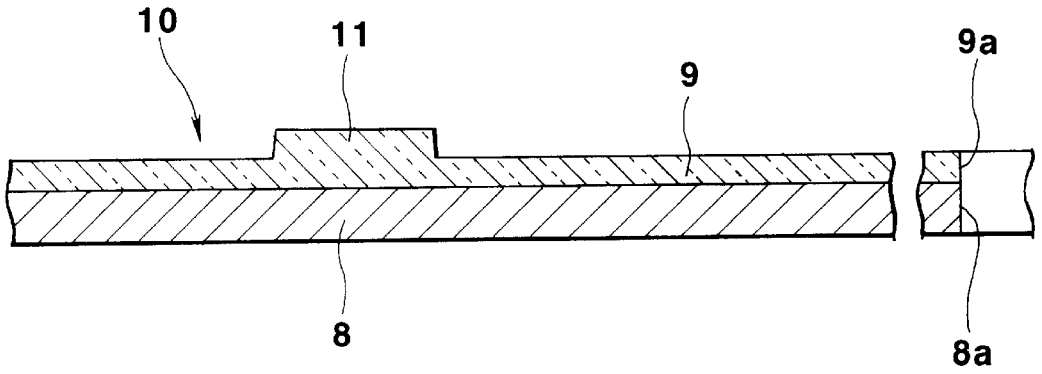
FIG. 2 is an enlarged fragmentary sectional view showing the luminescent device in the watch shown in FIG. 1.

FIG. 1 is a vertical sectional view showing a watch according to a first embodiment of the present invention, and FIG. 2 is a partially enlarged view showing a luminescent device in the watch.

In FIGS. 1 and 2, the reference numeral 1 denotes a watch case, the numeral 2 denotes a watch glass, the numeral 3 denotes a back cover, the numeral 4 denotes an analog hand mechanism, the numeral 5 denotes a body, the numeral 6 denotes shafts for hands, the numeral 7 denotes hands, the numeral 8 denotes an EL luminescent m ember (plate-like luminescent member), the numeral 9 denotes a translucent or transparent dial (panel member), the numeral 10 denotes a plate-like luminescent device, the numeral 11 denotes a protrusion, the numeral 12 denotes a clump member, and the numeral 13 denotes a sealing member.

The watch, as shown in FIG. 1, comprises the watch case 1 which has the watch glass 2 attached onto the upper portion thereof and the back cover 3 attached onto the lower portion thereof, and the analog hand mechanism 4 which is disposed in the watch case 1.

The analog hand mechanism 4 comprises a circuit board, a body 5 in which a battery and other parts are incorporated, shafts 6 for hands which extend from the center of the body 5 upwardly, and hands 7 which include an hour hand and a minute hand and the like and which are connected with the shafts 6 for hands, respectively.

On the upper surface of the body 5 of the analog hand mechanism 4, a plate-like EL luminescent member 8 and a dial 9 which has a translucent or transparent panel member, are layered. The luminescent device 10 comprises the plate-like EL luminescent member 8 and the translucent or transparent dial 9 and is therefore plate-like.

Through holes 8*a* and 9*a* are formed at each center of the EL luminescent member 8 and the dial 9 which form such a luminescent device 10, wherein the shaft 6 of the hands pass through the through holes 8*a* and 9*a* and extend upwardly.

On the upper surface of the dial 9, protrusions 11 for representing time indices are formed integrally, as shown in FIG. 2 which is an enlarged view thereof.

In order to form the protrusions 11 on the dial integrally, injection molding, press working, half die cutting, building up printing, or the like can be adopted.

The clump member 12 is a member for pressing the peripheries of the dial 9 and the EL luminescent member 8 to fix these members on the body 5, as shown in FIG. 1. A sealing member 13 is provided between the upper surface of the back cover 3 and the lower surface of the watch case 1.

In the luminescent device 10 having such a structure, when a predetermined voltage is applied from a power source (not shown in Figures) which is provided on a circuit board of the body 5 in the analog hand mechanism 4, the entirety of the surface of the EL luminescent member 8 emits light to illuminate the entirety of the translucent or transparent dial 9 which is provided at an upper position of the EL luminescent member 8.

Figure 3A:
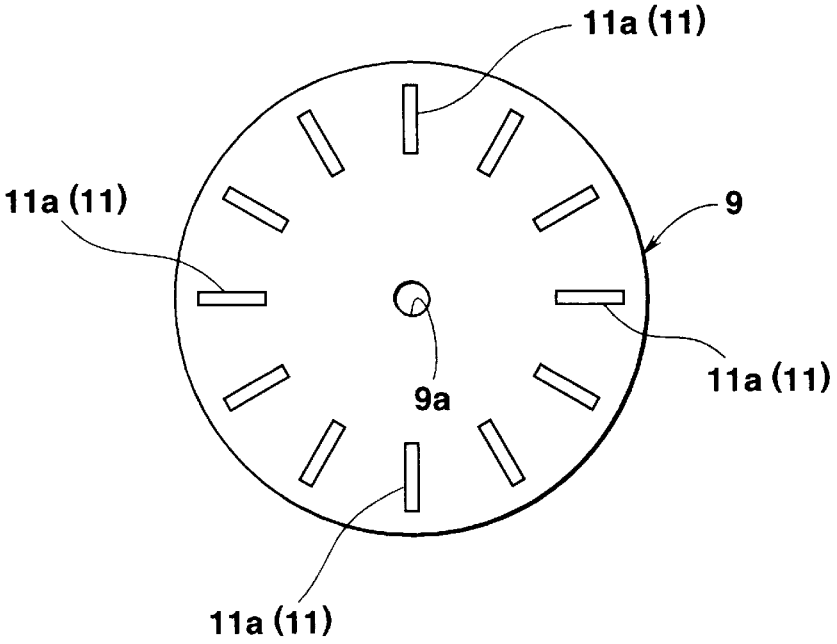
Figure 3B:
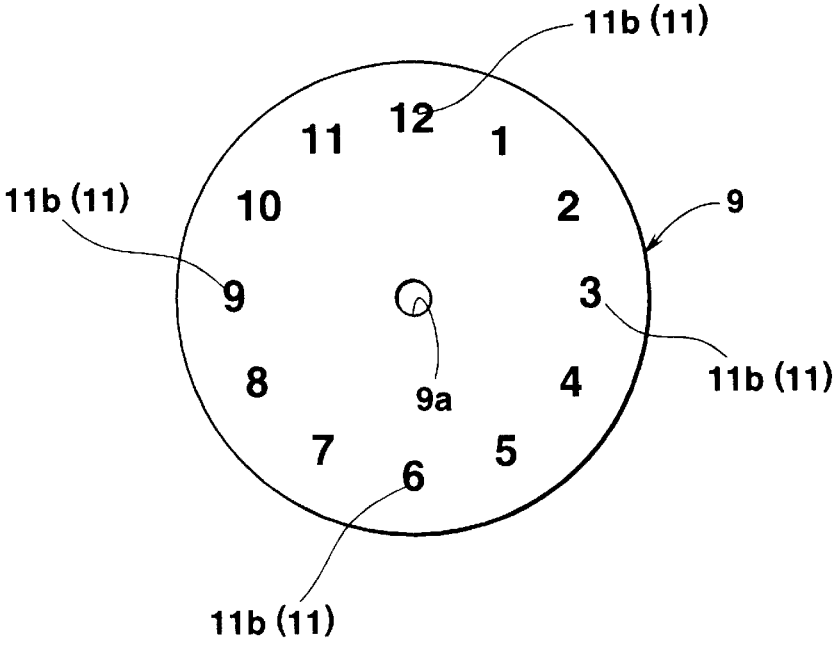

FIGS. 3A and 3B show an example of the structure of dial 9, wherein FIG. 3A is a plan view of the dial using stick-like indices as the protrusions 11 for representing hour indices, and FIG. 3B is a plan view of the dial using indices of numerals as the protrusions 11 for representing hour indices.

That is, the protrusions 11 for representing hour indices maybe simple stick-like hour indices 11*a*, 11*a*, 11*a*, and . . . which are arranged at the positions of one o'clock to twelve o'clock, as shown in FIG. 3A; and also may be hour indices of Arabic numerals 11*b*, 11*b*, 11*b*, and . . . which are arranged at the positions of one o'clock to twelve o'clock, as shown in FIG. 3B; and further may be hour indices of other logos, marks, desired figures or the like.

The upper surface of the dial 9 or the upper surface of the protrusions 11 may be decorated.

As a way of decorating the upper surface of the dial 9 or the upper surface of the protrusions 11, the way in which a deposited layer of metal, for example, aluminum, silver, gold or the like, the way using a color film, or the like may be adopted.

As a way of decorating the upper surface of the protrusions 11, the way in which a metal foil is adhered by roll leaf hot stamping, or the like may be adopted; and as a way of decorating the upper surface of the dial 9 other than the protrusions 11, the way in which a pattern is formed by electroforming, or the like may be adopted.

According to the watch having the above-described structure, when the entirety of the surface of the EL luminescent member 8 emits light, because the light passes upwardly through the dial 9 but do not pass through the hands 7 and 7 which are provided at an upper position thereof, it is possible to recognize the time distinctively by a complete contrast.

Because the protrusions 11 for representing hour indices are formed on the translucent or transparent dial 9 as a body the entirety of which is illuminated by the EL luminescent member 8, and are illuminated so as to rise up, it is possible to give a three-dimensional appearance which is different from a conventional film dial or the like having a plain appearance, and as a result, to give an interesting appearance and a feeling of high quality.

For example, adhesion of a metal foil on the upper surface of the protrusions 11 by electroforming or the like enables giving an appearance for the protrusions 11 for representing hour indices like ones made of metal.

Second Embodiment

Figure 4:
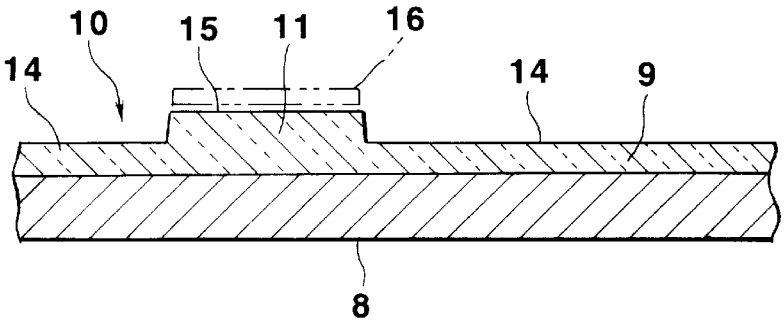
FIG. 4 is an enlarged vertical sectional view showing a luminescent device according to the second embodiment of the present invention.

FIG. 4 is an enlarged cross sectional view showing a luminescent device according to the second embodiment of the present invention.

In FIG. 4, the same numbers are attached to structural members, elements or the like corresponding to those shown in FIG. 2. Therefore, an explanation therefor will be omitted and only an explanation for points different from those in FIG. 2 will be explained, as follows.

In this embodiment, the upper surface of the dial 9 other than the protrusions 11 is processed to have a grained surface 14 frosted, and the upper surface of the protrusions 11 is processed to have a mirror surface 15 having a reflecting function, as shown in FIG. 4.

Because of the luminescent device having such a structure, when the entirety of the surface of the EL luminescent member 8 emits light, the mirror surface 15 of the upper surface of the protrusions 11 looks brighter than the grained surface 14 of the upper surface of the translucent or transparent dial 9 by the light transmitted through the surface surrounding the protrusions 11. Accordingly, it is possible to further increase interest thereto.

For example, a metallic layer or a printed (transparent, translucent or nontransparent) layer 16 with a color or the like may be formed on the mirror surface 15 of the upper surface of the protrusions 11, as shown by an imaginary line in FIG. 4.

Third Embodiment

Figure 5:
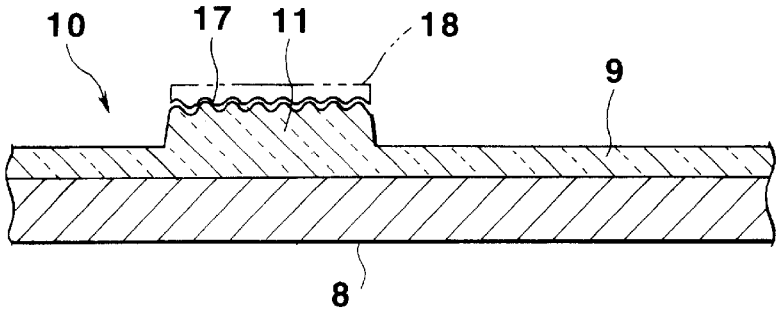
FIG. 5 is an enlarged vertical sectional view showing a luminescent device according to the third embodiment of the present invention.

FIG. 5 is an enlarged cross sectional view showing a luminescent device according to the third embodiment of the present invention.

In FIG. 5, the same numbers are attached to structural members, elements or the like corresponding to those shown in FIG. 2. Therefore, an explanation therefor will be omitted and only an explanation for points different from those in FIG. 2 will be explained, as follows.

In this embodiment, the upper surface of the protrusions 11 of the translucent or transparent dial 9 is processed in an irregular surface 17 having a diffusing and reflecting function, which was corrugated by electroforming or the like, as shown in FIG. 5.

Because of the luminescent device having such a structure, when the entirety of the surface of the EL luminescent member 8 emits light, the irregular surface 17 of the upper surface of the protrusions 11 of the translucent or transparent dial 9, i.e., the corrugated surface thereof, reflects and diffuses the light. As the result, the irregular surface 17 looks striking by the reflection and diffusion, in comparison with the other surface in the dial 9. Accordingly, it is possible to further increase interest thereto.

For example, a metallic layer or a printed (transparent, translucent or nontransparent) layer 18 with a color or the like may be formed on the irregular surface 17 of the upper surface of the protrusions 11, as shown by an imaginary line in FIG. 5.

Fourth Embodiment

Figure 6:
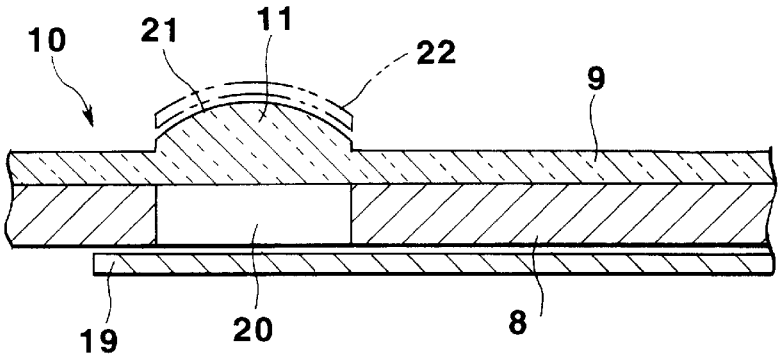
FIG. 6 is an enlarged vertical sectional view showing a luminescent device according to the fourth embodiment of the present invention.

FIG. 6 is an enlarged cross sectional view showing a luminescent device according to the fourth embodiment of the present invention.

In FIG. 6, the same numbers are attached to structural members, elements or the like corresponding to those shown in FIG. 2. Therefore, an explanation therefor will be omitted and only an explanation for points different from those in FIG. 2 will be explained, as follows.

In this embodiment, a date wheel 19 for indicating the date (or a day wheel for indicating the day) which is shown in the direction of three o'clock on an analog watch is provided under the EL luminescent member 8. In the EL luminescent member 8, a window 20 is formed at the position corresponding to the indication of the date (or the day). The window 20 also faces to the protrusions 11 of the dial 9. The upper portion of the protrusions 11 of the dial 9 forms a convex lens 21 having a function of magnifying indication elements and the like in the rear side.

Because of the luminescent device having such a structure, whichever the EL luminescent member 8 is in an on condition or in an off condition, the indication of the date (or the day) on the date wheel 19 can be magnified through the window 20 of the EL luminescent member 8 and through the convex lens 21 which is formed on the upper portion of the protrusions 11 of the translucent or transparent dial 9, so that it is possible to further increase interest thereto.

For example, a metallic layer or a printed (transparent, translucent or nontransparent) layer 22 with a color or the like may be formed on the convex lens 21 of the upper portion of the protrusions 11, as shown by an imaginary line in FIG. 6.

Fifth Embodiment

Figure 7:
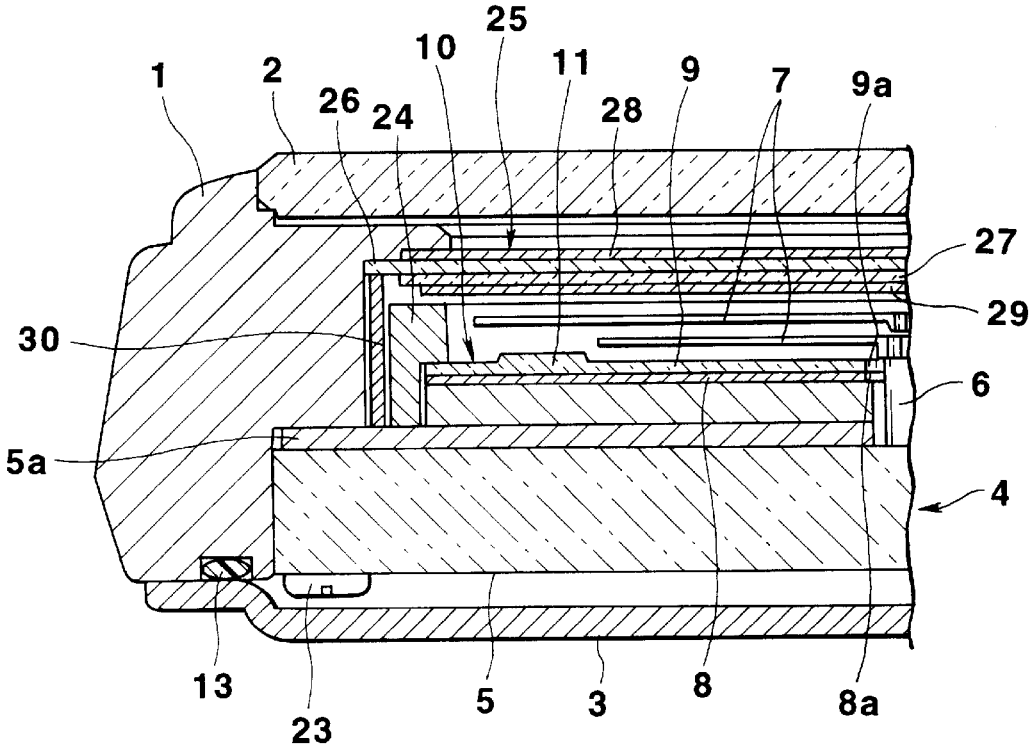
FIG. 7 is a vertical sectional view showing a schematic structure of an electronic watch (electronic apparatus) according to the fifth embodiment of the present invention.

FIG. 7 is a vertical sectional view showing a schematic construction of an electronic watch (electronic apparatus) according to the fifth embodiment of the present invention.

In FIG. 7, the same numbers are attached to structural members, elements or the like corresponding to those shown in FIG. 1. Therefore, an explanation therefor will be omitted and only an explanation for points different from those in FIG. 1 will be explained, as follows.

In this embodiment, the analog hand mechanism 4 is fixed to the watch case 1 by a screw 23, while the peripheries of the dial 9 and the EL luminescent member 8 are pressed against a dial cover 24 to fix these members on the body 5 of the analog hand mechanism 4, as shown in FIG. 7.

Between the watch glass 2 and the hands 7 and 7, a liquid crystal display device 25 which may be simply referred to an LCD in the following embodiments, for displaying the time and/or some information is provided.

The LCD 25 comprises an upper glass plate 26, a lower glass plate 27, an liquid crystal which is sealed between them, and a pair of polarizing plates 28 and 29 which are disposed on the upper and rear surfaces of the upper and lower glass plates 26 and 27, respectively.

A terminal portion provided on the lower surface of one glass plate 26 of the LCD 25 is electrically connected with a terminal portion on a circuit board 5*a* provided on the body 5 of the analog hand mechanism 4 through an interconnector 30.

In the embodiment, as the plate-like luminescent device 10, any one of the device of the first embodiment shown in FIG. 2, the device of the second embodiment shown in FIG. 4, the device of the third embodiment shown in FIG. 5, and the device of the fourth embodiment shown in FIG. 6, which are described above, may be adopted.

According to the electronic watch (electronic apparatus) having the above-described structure, it is possible to obtain the following advantage in addition to the above-described advantage obtained by the first, second, third or fourth embodiment.

Because the light emitted from the EL luminescent member 8 enables not only illumination of the LCD 25 which is disposed above the EL luminescent member 8 but also obtaining a visually deep appearance, that is, rising the protrusions 11 of the dial 9 up at a position deep in the LCD 25, it is possible to give an interesting appearance and a feeling of high quality.

Sixth Embodiment

Figure 8:
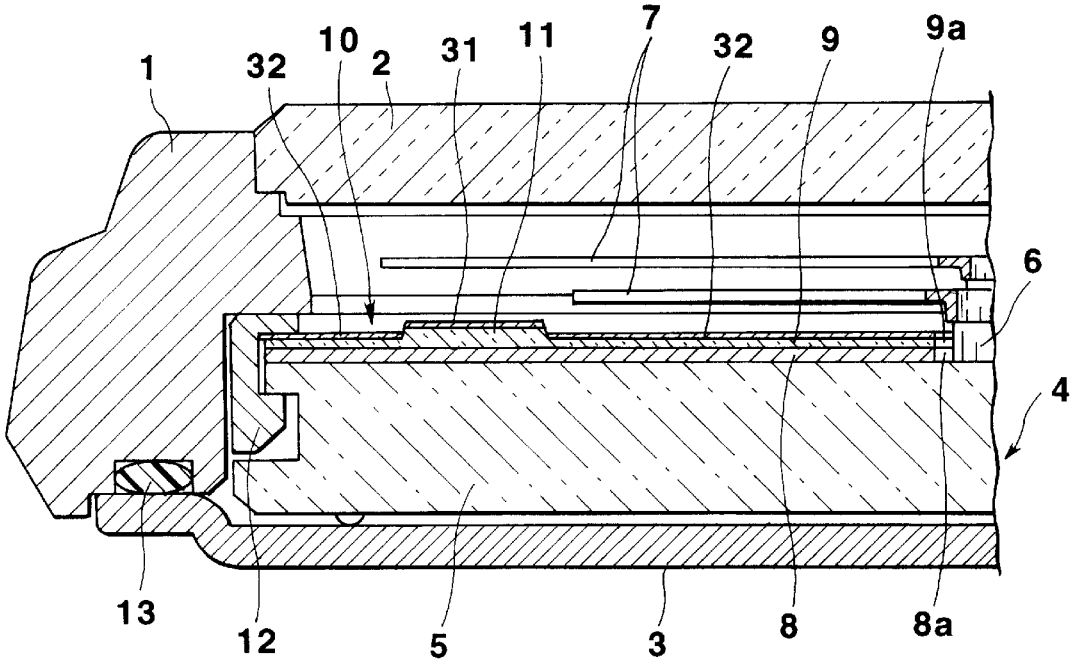
FIG. 8 is a vertical sectional view showing a schematic structure of a watch according to the sixth embodiment of the present invention.
Figure 9:
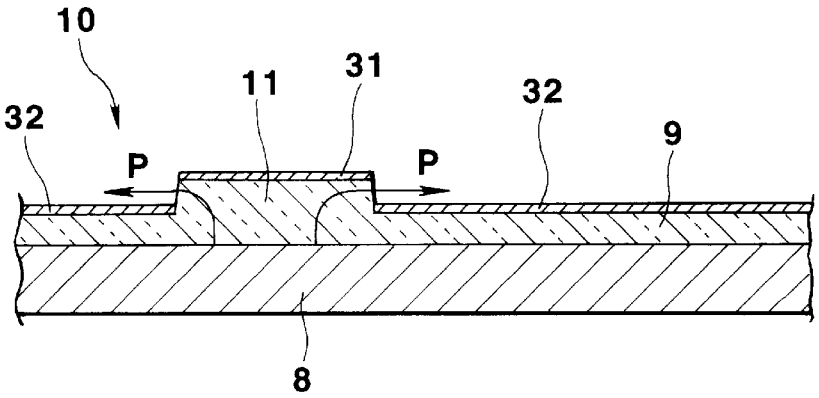
FIG. 9 is an enlarged fragmentary sectional view showing the luminescent device in the watch shown in FIG. 8.

FIG. 8 is a vertical sectional view showing a schematic construction of an electronic watch according to the sixth embodiment of the present invention, and FIG. 9 is a partially enlarged view showing a luminescent device in the watch.

In FIGS. 8 and 9, the same numbers are attached to structural members, elements or the like corresponding to those shown in FIG. 1. Therefore, an explanation therefor will be omitted and only an explanation for points different from those in FIG. 1 will be explained, as follows.

In this embodiment, a printed layer 31 is formed on the protrusions 11 of the dial 9 except the peripheral side surface thereof, and a printed layer 32 is formed on the upper surface of the dial 9, as shown in FIG. 8, and as largely shown in FIG. 9.

Therefore, only the peripheral side surface of the protrusions 11 on the dial 9 transmits light out, as shown by arrows P in FIG. 9.

Figure 10A:
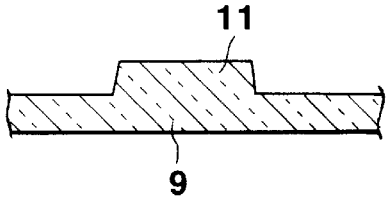
Figure 10B:
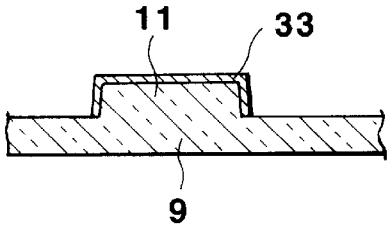
Figure 10C:
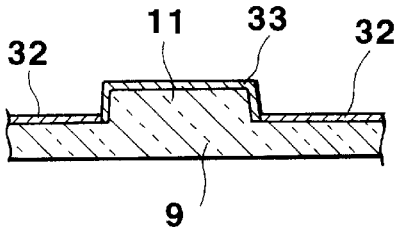
Figure 10D:
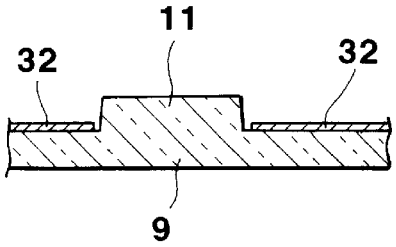
Figure 10E:
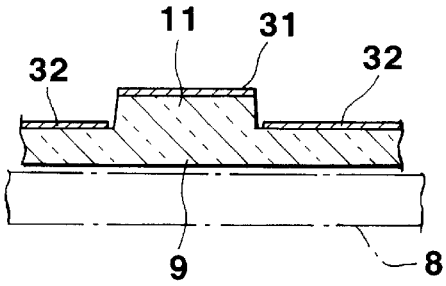

FIGS. 10A to 10E are for explaining a method for manufacturing the luminescent device 10 which is shown in FIGS. 8 and 9, in order. FIG. 10A is a sectional view showing a first step for forming the protrusions 11, FIG. 10B is a sectional view showing a second step for providing a masking layer, FIG. 10C is a sectional view showing a third step for printing, FIG. 10D is a sectional view showing a fourth step for removing the provided masking layer, and FIG. 10E is a sectional view showing a fifth step for printing.

As shown in FIG. 10A, in the first step, a dial 9 having protrusions 11 on the upper surface is formed by injection molding or another production method. In the second step, a masking layer 33 is formed on the peripheral side surface and the upper surface, of the protrusions 11, as shown in FIG. 10B. In the following third step, a printed layer 32 using a proper coloring ink is formed on the upper surface of the dial 9 except on the protrusions 11 having the masking layer 33, by printing, for example, offset printing, silk screen printing or the like, as shown in FIG. 10C.

Subsequently, in the fourth step, the masking layer 33 which covers the peripheral side surface and the upper surface of the protrusions 11 is removed, as shown in FIG. 10D. In fifth step, a printed layer 31 using a proper coloring ink is formed only on the upper surface of the protrusions 11 other than the peripheral side surface, from which the masking layer 33 was removed, by printing, for example, offset printing, silk screen printing or the like, as shown in FIG. 10E.

The dial 9 having the printed layers 31 and 32 formed by the above-described steps is laminated on the upper surface of the EL luminescent member 8, as shown in FIG. 9.

Instead of formation of the printed layers 31 and 32, painted layers by painting can be also formed.

According to the watch having the luminescent device 10 with such a structure, because the upper surface of the protrusions 11 of the translucent or transparent dial 9 provided on the EL luminescent member 8, and the upper surface of the dial 9 itself are decorated by the printed layers 31 and 32, it is possible to give a three-dimensional appearance. Further, it is possible to give an interesting appearance and a feeling of high quality because of giving a color effect by the printed layers 31 and 32.

When the entirety of the surface of the EL luminescent member 8 emits light, the light passes through the peripheral side surfaces of the protrusions 11 of the dial 9, as shown by arrows P and P in FIG. 9, to illuminate the printed layer 32 on the upper surface of the dial 9 from the side, while illuminating the hands 7 and 7 arranged above and illuminating to rise up the printed layer 31 on the upper surface of the protrusions 11 from the surroundings, so that it is possible to give a further interesting appearance.

Seventh Embodiment

Figure 11:
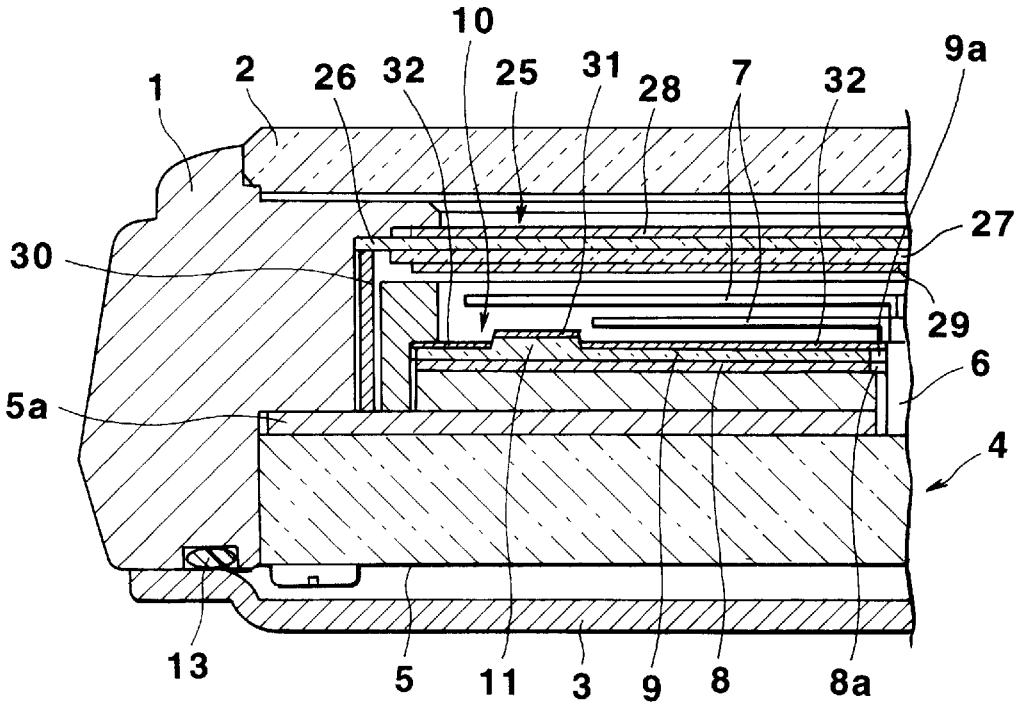
FIG. 11 is a vertical sectional view showing a schematic structure of an electronic watch (electronic apparatus) according to the seventh embodiment of the present invention.

FIG. 11 is a vertical sectional view showing a schematic construction of an electronic watch (electronic apparatus) according to the seventh embodiment of the present invention.

In FIG. 11, the same numbers are attached to structural members, elements or the like corresponding to those shown in FIGS. 7, 8 and 9.

This embodiment is different from the previous embodiment shown in FIG. 8 in that an LCD 25 is arranged between the watch glass 2 and hands 7 and 7, as shown in FIG. 11.

According to the electronic watch (electronic apparatus) having the above-described structure, it is possible to obtain the following advantage in addition to the above-described advantage obtained by the sixth embodiment.

That is, the light emitted from the EL luminescent member 8 passes through the peripheral side surfaces of the protrusions 11 of the dial 9, and illuminates the LCD 25 arranged above the protrusions. As a result, because it is possible to obtain a visually deep appearance, that is, to rise up the printed layer 31 on the upper surface of the protrusions 11 of the dial 9 from the surroundings at a position deep in the LCD 25, it is possible to give a further interesting appearance and a feeling of higher quality.

Eighth Embodiment

Figure 12:
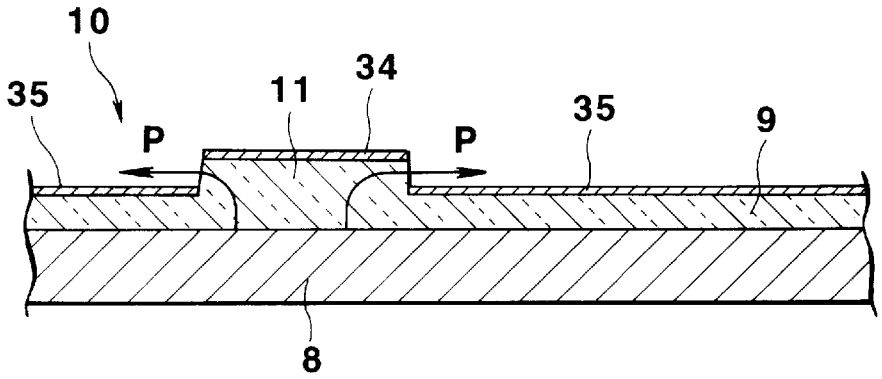
FIG. 12 is an enlarged vertical sectional view showing a luminescent device according to the eighth embodiment of the present invention.

FIG. 12 is an enlarged vertical sectional view showing a luminescent device according to the eighth embodiment of the present invention.

In FIG. 12, the same numbers are attached to structural members, elements or the like corresponding to those shown in FIG. 9. Therefore, an explanation therefor will be omitted and only an explanation for points different from those in FIG. 9 will be explained, as follows.

In this embodiment, a metallic layer 34 is formed on the protrusions 11 of the dial 9 except the peripheral side surface thereof, and a metallic layer 35 is also formed on the upper surface of the dial 9, as shown in FIG. 12.

Therefore, only the peripheral side surface of the protrusions 11 on the dial 9 transmits light, as shown by arrows P in FIG. 12.

Figure 13A:
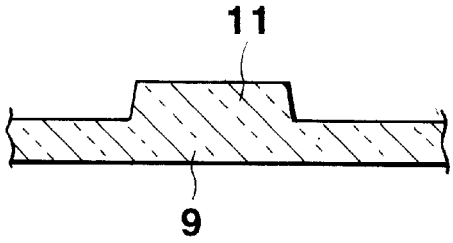
Figure 13B:
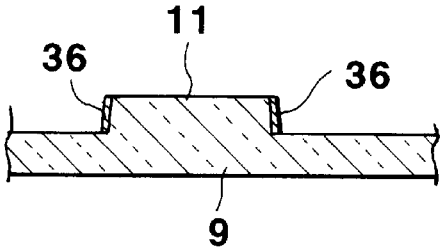
Figure 13C:
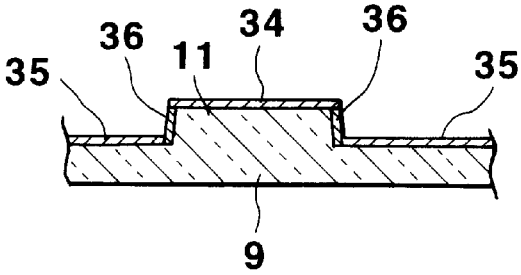
Figure 13D:
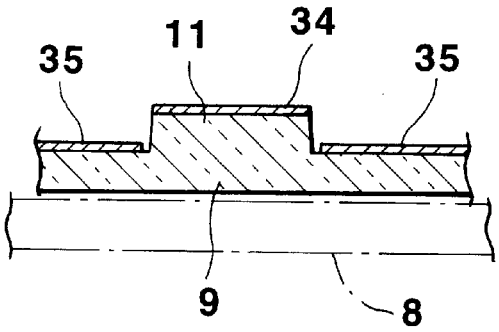

FIGS. 13A to 13D are for explaining a method for manufacturing the luminescent device 10 which is shown in FIG. 12, in order. FIG. 13A is a sectional view showing a first step for forming the protrusions 11, FIG. 13B is a sectional view showing a second step for providing a masking layer, FIG. 13C is a sectional view showing a third step for a vapor deposition, and FIG. 13D is a sectional view showing a fourth step for removing the provided masking layer.

As shown in FIG. 13A, in the first step, a dial 9 having protrusions 11 on the upper surface thereof is formed by injection molding or another production method. In the second step, a masking layer 36 is formed on only the peripheral side surface of the protrusions 11, as shown in FIG. 13B. In the following third step, metallic layers 34 and 35 are formed on the surface of the protrusions 11 except the peripheral side surface having the provided masking layer 36, and on the upper surface of the dial 9 at the same time, by vapor deposition of a metal, e.g., aluminum, silver, gold, or the like, as shown in FIG. 13C.

Subsequently, in the fourth step, the provided masking layer 36 which covers the peripheral side surface of the protrusions 11 is removed, as shown in FIG. 14D.

In the final fifth step, the dial 9 having the formed metallic layers 34 and 35 is placed on the upper surface of the EL luminescent member 8, as shown in FIG. 12.

In order to form the metallic layers 34 and 35, lamination of a metal foil by using hot stamping can be adopted in place of vapor deposition.

According to the watch having the luminescent device 10 having such a structure, because the upper surface of the protrusions 11 of the translucent or transparent dial 9 provided on the EL luminescent member 8, and the upper surface of the dial 9 itself are decorated by the metallic layers 34 and 35, it is possible to give a three-dimensional appearance. Further, it is possible to provide an interesting appearance and a feeling of high quality because the metallic layers 34 and 35 give a metallic polish feeling like a metallic dial.

When the entirety of the surface of the EL luminescent member 8 emits light, the light passes through the peripheral side surfaces of the protrusions 11 of the dial 9, as shown by arrows P and P in FIG. 12, to illuminate the metallic layer 35 on the upper surface of the dial 9 from the side, while illuminating the hands 7 and 7 arranged above (as shown in FIG. 8) and illuminating to rise up the metallic layer 34 on the upper surface of the protrusions 11 from the surroundings, so that it is possible to give a further interesting appearance.

It is a matter of course that the luminescent device 10 having such a structure according to the embodiment can be applied for the electronic watch (electronic apparatus) according to the above-described seventh embodiment (as shown in FIG. 11).

Ninth Embodiment

Figure 14:
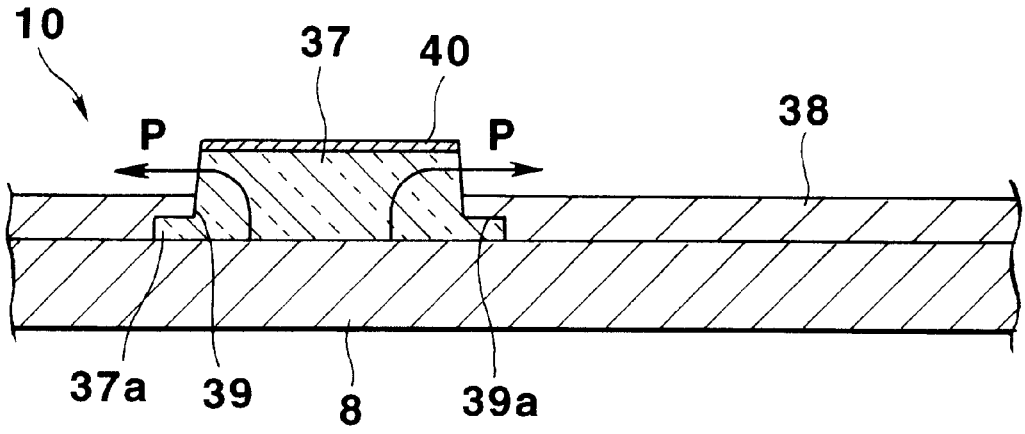
FIG. 14 is an enlarged vertical sectional view showing a luminescent device according to the ninth embodiment of the present invention.

FIG. 14 is an enlarged vertical sectional view showing a luminescent device according to the ninth embodiment of the present invention.

In FIG. 14, the same numbers are attached to structural members, elements or the like corresponding to those shown in FIG. 9. Therefore, an explanation therefor will be omitted and only an explanation for points different from those in FIG. 9 will be explained, as follows.

In this embodiment, translucent or transparent protrusion members 37 and a metallic dial (metallic panel) 38 are provided on the EL luminescent member 8, and a metallic layer 40 is provided on the upper surface of each protrusion member 37 which was set into a hole 39 formed in the metallic dial 38, as shown in FIG. 14.

That is, on the upper surface of the EL luminescent member 8, protrusion members 37 made of translucent or transparent resin, for representing hour indices, and a metallic dial 38 of metallic panel having holes 39 formed therein are placed. Each hole 39 has a shape so that each protrusion member 37 can be set into the hole 39 from the lower position to project upwardly from the hole.

The lower peripheral portion of the protrusion member 37 has a flange portion 37*a* with a large diameter, and the lower side of the hole 39 has a recess portion 39*a* with a large diameter. The protrusion member 37 and the hole 39 are formed so that the lower flange portion 37*a* with a large diameter, of the protrusion member 37 fits in the lower recess portion 39*a* with a large diameter, of the hole 39 and the protrusion member 37 is prevented from passing through the hole 39 upwardly.

The metallic layer 40 is formed on only the upper surface of the protrusion member 37 projecting upwardly from the metallic dial 38.

Figure 15A:
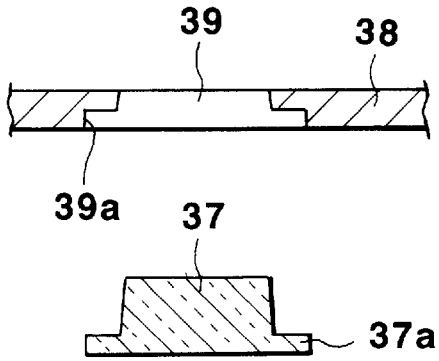
Figure 15B:
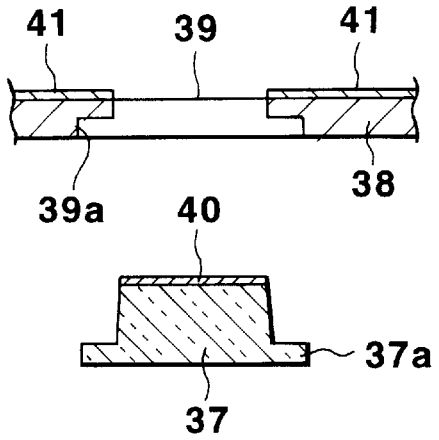
Figure 15C:
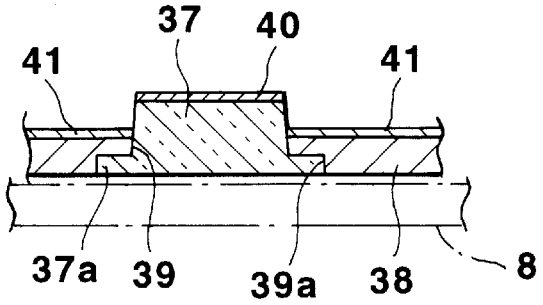

FIGS. 15A to 15C are for explaining a method for manufacturing the luminescent device 10 which is shown in FIG. 14, in order. FIG. 15A is an exploded sectional view showing a first step for forming the holes 39 in the metallic dial 38 and forming the protrusion members 37, FIG. 15B is an exploded sectional view showing a second step for decorating the metallic dial 38 and the protrusion members 37, and FIG. 15C is a sectional view showing a third step for setting the protrusion members 37 into the holes 39 formed in the metallic dial 38.

As shown in FIG. 15A, in the first step, protrusion members 37 are produced by injection molding or the like while a metallic dial 38 having holes 39 for the protrusion members 37 is produced by press working or the like.

In the second step, a metallic layer 40 is formed on the upper surface of the protrusion member 37 by vapor deposition of a metal, e.g., aluminum, silver, gold, or the like, as shown in FIG. 15B, while a proper decorative layer 41 is formed on the upper surface of the metallic dial 38 by a proper method, for example, printing using a coloring ink, adhesion of a color film, formation of a pattern by electroforming, or the like.

Subsequently, in the third step, each protrusion member 37 is inserted in the hole 39 of the metallic dial 38 from the lower position, as shown in FIG. 15C, to fit the lower flange portion 37*a* with a large diameter, of the protrusion member 37 into the lower recess portion 39*a* with a large diameter, of the hole 39, so that the protrusion member 37 is prevented from passing through the hole 39 upwardly. Thus, each protrusion member 37 is firmly set in the hole 39 of the metallic dial 38.

In the final fourth step, the protrusion members 37 and the metallic dial 38, which are assembled is placed on the upper surface of the EL luminescent member 8, as shown in FIG. 14.

In place of formation of the metallic layer 40, a printing layer or a painting layer may be formed. Formation of the decorative layer 41 is not necessarily required.

According to the watch having the luminescent device 10 with such a structure, because the dial is decorated by the metallic dial 38 on the upper surface of the EL luminescent member 8 and the metallic layers 40 on the upper surface of the protrusion members 37 which project upwardly from the dial 38, it is possible to give a three-dimensional appearance; and to provide an interesting appearance and a feeling of high quality because not only the metallic dial 38 but also the metallic layers 40 give a metallic polish feeling.

When the entirety of the surface of the EL luminescent member 8 emits light, the light passes through the peripheral side surfaces of the protrusion members 37 of the metallic dial 38, as shown by arrows P and P in FIG. 14, to illuminate the upper surface of the metallic dial 38 from the side, while illuminating the hands 7 and 7 arranged above (as shown in FIG. 8) and illuminating to rise up the metallic layer 40 on the upper surface of the protrusion members 37 from the surroundings, so that it is possible to give a further interesting appearance.

It is a matter of course that the luminescent device 10 having such a structure according to the embodiment can be applied for the electronic watch (electronic apparatus) according to the above-described seventh embodiment (as shown in FIG. 11).

As described above, the luminescent device (10) according to the embodiments, as shown in FIGS. 1, 2, 4–6, and 7–13D, comprises; a plate-like luminescent member (8), a translucent or transparent panel member (9) which is disposed on an upper surface of the plate-like luminescent member, and a protrusion (11) formed on an upper surface of the panel member.

For example, the luminescent device has a display function and is incorporated in various types of electronic apparatuses, e.g., an electronic watch, an electronic pocket notebook and the like.

As the plate-like luminescent member, for example, an EL luminescent member is adopted typically, and one of various types of luminescent members, e.g., a lamp, a fluorescent lamp or the like may be also adopted.

As the translucent or transparent panel member, for example, a dial for a watch is adopted typically, and another display plate may be also adopted.

The protrusion is, for example, a display element such as a time index, a logo or the like.

The protrusion can be formed, for example, by an integration processing using injection molding, a buildup processing using a clear ink, an embossing press, or the like.

According to the luminescent device of the embodiment, because the protrusion is formed on the upper surface of the translucent or transparent panel member which is disposed on the upper surface of the plate-like luminescent member, the light emitted from the lower plate-like luminescent member passes upwardly through the panel member and illuminates to rise up the protrusion formed on the upper surface thereof, so that it is possible to give a three-dimensional appearance and as a result, to give an interesting appearance and a feeling of high quality.

As shown in FIG. 4, a mirror surface (15) may be formed on an upper surface of the protrusion and a grained surface (14) may be formed on the upper surface of the panel member except the protrusion.

The mirror surface is, for example, one having a surface reflecting function.

A metallic layer or a printed (transparent, translucent or nontransparent) layer with a color or the like can be formed on the mirror surface.

The grained surface includes a frosted surface.

According to the luminescent device of the above embodiment, because a mirror surface is formed on an upper surface of the protrusion and a grained surface is formed on the upper surface of the panel member except the protrusion, when the plate-like luminescent member turns on, the mirror surface of the upper surface of the protrusions looks brighter than the grained surface of the upper surface of the panel member. Accordingly, it is possible to further increase interest thereto.

As shown in FIG. 5, an irregular surface (17) may be also formed on the upper surface of the protrusion.

The irregular surface may be a corrugated one processed by electroforming or the like, typically, and it means one having a diffusing and reflecting function.

A metallic layer or a printed (transparent, translucent or nontransparent) layer with a color or the like can be formed on the irregular surface.

According to the luminescent device having such a structure, because an irregular surface is formed on the upper surface of the protrusion, when the lower plate-like luminescent member turns on, the irregular surface of the upper surface of the protrusions looks brighter than the upper surface of the panel member. Accordingly, it is possible to further increase interest thereto.

As shown in FIG. 6, the protrusion may also comprise a convex lens (21).

The convex lens is, for example, one having a function for magnifying a display element or the like in the rear side thereof.

A metallic layer or a printed (transparent, translucent or nontransparent) layer with a color or the like can be formed on the upper surface of the convex lens.

According to the luminescent device having such a structure, because the protrusion comprises a convex lens, when the lower plate-like luminescent member turns on, a portion of the display element or the like in the rear side can be magnified through the convex lens. Accordingly, it is possible to further increase interest thereto.

Further, as shown in FIGS. 8–13, a printed layer (31 and 32) or a metallic layer (34 and 35) may be formed on the upper surface of the protrusion and on the upper surface of the panel member except a peripheral side surface of the protrusion.

The printed layer can be formed by, for example, offset printing, silk screen printing or the like.

The metallic layer can be formed, for example, by vapor deposition of a metal, e.g., aluminum, silver, gold, or the like; or by lamination of a metal foil by using hot stamping.

According to the luminescent device of the above embodiment, because a printed layer or a metallic layer is formed on the upper surface of the protrusion and on the upper surface of the panel member except a peripheral side surface of the protrusion, when the lower plate-like luminescent member turns on, although the light from the luminescent member does not transmit through the upper surface of the panel member nor through the upper surface of the protrusion, the light passes through the peripheral side surfaces of the protrusion, to illuminate the printed layer or the metallic layer on the upper surface of the panel member around the protrusions, from the side. As the result, the surrounding portion of the printed layer or the metallic layer of the panel member around the protrusions looks brighter, so that it is possible to further increase interest thereto.

Further, it is possible to enhance a feeling of higher quality by the metallic layers on the upper surface of the panel member and on the upper surface of the protrusion.

The luminescent device (10) according to the embodiment, as shown in FIG. 14, comprises; a plate-like luminescent member (8), a translucent or transparent protrusion member which is disposed on an upper surface of the plate-like luminescent member (37), a metallic panel (38) which is disposed on an upper surface of the plate-like luminescent member except the protrusion member, and a printed layer (31) or a metallic layer (40), which is formed on an upper surface of the protrusion member projecting from an upper surface of the metallic panel, except a peripheral side surface of the protrusion member.

For example, the luminescent device has a display function and can be incorporated in various types of electronic apparatuses, e.g., an electronic watch, an electronic pocket notebook and the like.

As the plate-like luminescent member, for example, an EL luminescent member is adopted typically, and one of various types of luminescent members, e.g., a lamp, a fluorescent lamp or the like may be also adopted.

As the translucent or transparent protrusion member is, for example, a display element such as a time index, a logo or the like.

Although the metallic panel is, for example, a dial for watch typically, it may be another display plate.

The printed layer is formed by, for example, offset printing, silk screen printing or the like.

The metallic layer is formed, for example, by vapor deposition of a metal, e.g., aluminum, silver, gold, or the like; or by lamination of a metal foil by using hot stamping.

According to the luminescent device of the above embodiment, because a translucent or transparent protrusion member is disposed on an upper surface of a plate-like luminescent member, and a metallic panel is disposed on an upper surface of the plate-like luminescent member except the protrusion member, and a printed layer or a metallic layer is formed on an upper surface of the protrusion member projecting from an upper surface of the metallic panel, except a peripheral side surface of the protrusion member, it is possible to give a three-dimensional appearance by the protrusion member projecting from the upper surface of the metallic panel and as a result, to give an interesting appearance. Further, it is possible to give a feeling of high quality by the metallic panel and the metallic layer on the upper surface of the protrusion member.

When the lower plate-like luminescent member turns on, although the light from the luminescent member does not transmit through the metallic panel nor the metallic layer of the upper surface of the protrusion member, the light passes through the peripheral side surfaces of the protrusion member to illuminate the surroundings of the metallic layer of the upper surface of the protrusion member, as the result, it is possible to further increase interest thereto.

The timepiece according to the embodiment, as shown in FIGS. 1, 7 and 11, comprises; the above-described luminescent device (10), and a timepiece case (1) containing an analog hand mechanism (4) having hands (7), therein, wherein the luminescent device is arranged in the timepiece case to illuminate the analog hand mechanism.

Although the timepiece is, for example, a wristwatch typically, it may be a clock including a table clock, wall clock or the like.

The hands means a hour hand, a minute hand and a second hand generally, however, they may have no second hand.

For example, the analog hand mechanism comprises; a body in which a circuit board, a battery and other parts are incorporated, hand shafts extending from the center of the body upwardly, and hands which include an hour hand and a minute hand and the like and which are attached to the shafts for hands, respectively.

According to the timepiece of the above embodiment, because a luminescent device is arranged in the timepiece case to illuminate the analog hand mechanism, the light emitted from the lower plate-like luminescent member passes upwardly through the panel member and illuminates to rise up the protrusion formed on the upper surface thereof, while illuminating the hands arranged at higher positions, so that it is possible to give a three-dimensional appearance and as a result, to give an interesting appearance and a feeling of high quality.

In the clock, indices for representing time may be formed on the panel member (9).

The electronic apparatus according to the embodiment, as shown in FIG. 11, comprises; the above-described luminescent device (10), and an apparatus case (1) containing a liquid crystal display device (25) therein, wherein the luminescent device is arranged in the apparatus case to illuminate the liquid crystal display device.

Although the electronic apparatus is, for example, an electronic watch typically, it may be an electronic clock such as an electronic table clock, an electronic wall clock, an electronic pocket notebook, and the like.

According to the electronic apparatus of the above embodiment, because the above-described luminescent device is arranged in the apparatus case to illuminate the liquid crystal display device, the light emitted from the lower plate-like luminescent member passes upwardly through the panel member and illuminates to rise up the protrusion formed on the upper surface thereof so that it is possible to give a three-dimensional appearance, while illuminating the liquid crystal display device arranged at a higher position. Consequently, it is possible to give a visually deep appearance, that is, to rise the protrusions up at a position deep in the LCD and as a result, to give an interesting appearance and a feeling of high quality.

In the electronic apparatus, the luminescent device may be arranged under the liquid crystal display device.

According to the electronic apparatus having such a structure, because the luminescent device may be arranged under the liquid crystal display device, it is possible to give a further interesting appearance and a feeling of higher quality.

The method for manufacturing a luminescent device according to the embodiment, as shown in FIGS. 10A–10E, comprises; a first step for forming a protrusion (11) on an upper surface of a translucent or transparent panel member (9); a second step for providing a masking layer (33) on a peripheral side surface and an upper surface, of the protrusion; a third step for forming a printed layer (32) on an upper surface of the panel member except on the peripheral side surface and the upper surface of the protrusion which have the provided masking layer; a fourth step for forming a printed layer (31) on the upper surface of the protrusion, after removing the provided masking layer from the protrusions; and a fifth step for arranging a plate-like luminescent member (8) on a lower surface of the panel member to which the fourth step was carried out, to manufacture the luminescent device.

For example, the luminescent device has a display function and can be incorporated in various types of electronic apparatuses, e.g., an electronic watch, an electronic pocket notebook and the like.

As the translucent or transparent panel member, for example, a dial for a watch may be adopted typically, and another display plate may be also adopted.

The protrusion is, for example, a display element such as a time index, a logo or the like.

The protrusion can be formed, for example, by an integration processing using injection molding, a buildup processing using a clear ink, an embossing press, or the like.

The masking layer is formed on a surface on which no printed layer will be formed in the following step.

The printed layer can be formed by, for example, offset printing, silk screen printing or the like.

As the plate-like luminescent member, for example, an EL luminescent member may be adopted typically, and one of various types of luminescent members, e.g., a lamp, a fluorescent lamp or the like may be also adopted.

According to the method for manufacturing a luminescent device of the embodiment, it is possible to provide a luminescent device in which a printed layer is formed on the upper surface of a protrusion and on the upper surface of the panel member, for example, as shown in FIGS. 8–11, by forming a protrusion on an upper surface of a translucent or transparent panel member, by providing a masking layer on a peripheral side surface and an upper surface, of the protrusion, by forming a printed layer on an upper surface of the panel member, by forming a printed layer on the upper surface of the protrusion after removing the masking layer from the protrusions, and by arranging the panel member on the upper surface of a plate-like luminescent member.

The method for manufacturing a luminescent device according to the embodiment, as shown in FIGS. 13A–13D, comprises; a first step for providing a masking layer (36) on a peripheral side surface of a protrusion (11) which is formed on an upper surface of a translucent or transparent panel member (9); a second step for forming metallic layers (34 and 35) on upper surfaces of the protrusion and of the panel member, except on the peripheral side surface of the protrusion which have the provided masking layer; a third step for removing the provided masking layer (36) from the protrusions; and a fourth step for arranging a plate-like luminescent member (8) on a lower surface of the panel member to which the third step was carried out, to manufacture the luminescent device.

For example, the luminescent device has a display function and can be incorporated in various types of electronic apparatuses, e.g., an electronic watch, an electronic pocket notebook and the like.

The translucent or transparent panel member can be used, for example, as a dial for a watch typically, and also as another display plate.

The protrusion may be, for example, a display element such as a time index, a logo or the like.

The protrusion can be formed, for example, by an integration processing using injection molding, a buildup processing using a clear ink, an embossing press, or the like.

The masking layer is formed on a surface on which no metallic layer will be formed in the following step.

The metallic layer can be formed, for example, by vapor deposition of a metal, e.g., aluminum, silver, gold, or the like; or by lamination of a metal foil by using hot stamping.

As the plate-like luminescent member, for example, an EL luminescent member may be adopted typically, and one of various types of luminescent members, e.g., a lamp, a fluorescent lamp or the like may be also adopted.

According to the method for manufacturing a luminescent device of the embodiment, it is possible to provide a luminescent device in which a metallic layer is formed on the upper surface of the panel member on the plate-like luminescent member and on the upper surface of the protrusion, for example, as shown in FIGS. 12–13D, by providing a masking layer on a peripheral side surface of a protrusion which is formed on an upper surface of a translucent or transparent panel member, by forming a metallic layer on upper surfaces of the panel member and of the protrusion, after removing the masking layer from the protrusions, and by arranging the panel member on the upper surface of a plate-like luminescent member.

The method for manufacturing a luminescent device according to the embodiment, as shown in FIGS. 15A–15C, comprises; a first step for forming a translucent or transparent protrusion member (37) and forming a hole (39) having a shape corresponding to the protrusion member in a metallic panel (38); a second step for forming a printed layer (40) or a metallic layer (40) on an upper surface of the protrusion member and forming a decorative layer (41) on an upper surface of the metallic panel; a third step for setting the protrusion member in the hole of the metallic panel; and a fourth step for arranging the protrusion member and the metallic panel on an upper surface of a plate-like luminescent member (8), to manufacture the luminescent device.

For example, the luminescent device has a display function and can be incorporated in various types of electronic apparatuses, e.g., an electronic watch, an electronic pocket notebook and the like.

The translucent or transparent protrusion may be, for example, a display element such as a time index, a logo or the like.

The metallic panel can be used, for example, as a dial for a watch typically, and also as another display plate.

The hole is for fitting the protrusion member therein.

The metallic layer can be formed, for example, by vapor deposition of a metal, e.g., aluminum, silver, gold, or the like; or by lamination of a metal foil by using hot stamping.

The decorative layer can be formed by a proper method, for example, printing using a coloring ink, adhesion of a color film, formation of a pattern by electroforming, or the like.

As the plate-like luminescent member, for example, an EL luminescent member may be adopted typically, and one of various types of luminescent members, e.g., a lamp, a fluorescent lamp or the like may be also adopted.

According to the method for manufacturing a luminescent device of the embodiment, it is possible to provide a luminescent device, as shown in FIG. 14, in which a metallic layer and a protrusion member are disposed on a plate-like luminescent member, and a printed layer and or a metallic layer are formed on the upper surface of the protrusion member; by forming a translucent or transparent protrusion member and forming a hole having a shape corresponding to the protrusion member in a metallic panel; by forming a printed layer or a metallic layer on an upper surface of the protrusion member and forming a decorative layer on an upper surface of the metallic panel; by setting the protrusion member in the hole of the metallic panel; and by arranging the protrusion member and the metallic panel on a lower surface of a plate-like luminescent member.

Although the present invention is explained for only an electronic watch in the above embodiments, the invention can be also applied for an electronic apparatus other than an electronic watch, for example, an electronic pocket notebook, a pager, a personal computer, and the like. Various changes and modifications in a concrete particular structure and the like can be suitably made to the invention.

In accordance with the luminescent device which is one aspect of the present invention, which comprises, a plate-like luminescent member, a translucent or transparent panel member which is disposed on an upper surface of the plate-like luminescent member, and a protrusion formed on an upper surface of the panel member, because the light emitted from the lower plate-like luminescent member passes upwardly through the panel member and illuminates to rise up the protrusion formed on the upper surface thereof, it is possible to give a three-dimensional appearance and as a result, to give an interesting appearance and a feeling of high quality.

In accordance with the luminescent device which is another aspect of the present invention, which comprises, a plate-like luminescent member, a translucent or transparent protrusion member which is disposed on an upper surface of the plate-like luminescent member, a metallic panel which is disposed on an upper surface of the plate-like luminescent member except the protrusion member, and a printed layer or a metallic layer, which is formed on an upper surface of the protrusion member projecting from an upper surface of the metallic panel, except a peripheral side surface of the protrusion member, because it is possible to give a three-dimensional appearance by the protrusion member projecting from the upper surface of the metallic panel and as a result, to give an interesting appearance. Further, it is possible to give a feeling of high quality by the metallic panel and the metallic layer on the upper surface of the protrusion member.

When the lower plate-like luminescent member turns on, the light passes through the peripheral side surfaces of the protrusion member to illuminate the surroundings of the metallic layer of the upper surface of the protrusion member, as the result, it is possible to further increase interest thereto.

In accordance with the timepiece which is another aspect of the present invention, which comprises, a luminescent device as claimed in claim 1, and a timepiece case containing an analog hand mechanism having hands, therein, wherein the luminescent device is arranged in the timepiece case to illuminate the analog hand mechanism, because the light emitted from the lower plate-like luminescent member passes upwardly through the panel member and illuminates to rise up the protrusion formed on the upper surface thereof, while illuminating the hands arranged at higher positions, it is possible to give a three-dimensional appearance and as a result, to give an interesting appearance and a feeling of high quality.

In accordance with the method for manufacturing a luminescent device, which is another aspect of the present invention, which comprises: a first step for forming a protrusion on an upper surface of a translucent or transparent panel member; a second step for providing a masking layer on a peripheral side surface and an upper surface, of the protrusion; a third step for forming a printed layer on an upper surface of the panel member except on the peripheral side surface and the upper surface of the protrusion, which have the masking layer; a fourth step for forming a printed layer on the upper surface of the protrusion, after removing the masking layer from the protrusions; and a fifth step for arranging a plate-like luminescent member on a lower surface of the panel member to which the fourth step was carried out, to manufacture the luminescent device, it is possible to provide a luminescent device in which a printed layer is formed on the upper surface of a protrusion and on the upper surface of the panel member, for example, as shown in FIGS. 8–11.

What is claimed is:

1. A luminescent device comprising:

a plate-like luminescent member;

a translucent or transparent panel member which is disposed on an upper surface of the plate-like luminescent member, and a protrusion integrally formed on an upper surface of the translucent or transparent panel member and representing a time index, said protrusion also being translucent or transparent.

2. A luminescent device as claimed in claim 1, wherein:

a mirror surface is formed on an upper surface of the protrusion; and a grained surface is formed on the upper surface of the panel member except the protrusion.

3. A luminescent device as claimed in claim 1, wherein an irregular surface is formed on the upper surface of the protrusion.

4. A luminescent device as claimed in claim 1, wherein the protrusion comprises a convex lens.

5. A luminescent device as claimed in claim 1, wherein a printed layer or a metallic layer is formed on an upper surface of the protrusion and on the upper surface of the panel member except a peripheral side surface of the protrusion.

6. A timepiece comprising:

a luminescent device as claimed in claim 1, and a timepiece case containing an analog hand mechanism having hands, therein, wherein the luminescent device is arranged in the timepiece case to illuminate the analog hand mechanism.

7. A timepiece as claimed in claim 6, wherein the protrusion representing a time index has one of a shape of a stick-like index, an Arabic numeral, a logo, and a mark.

8. An electronic apparatus comprising:

a luminescent device as claimed in claim 1, and an apparatus case containing a liquid crystal display device therein, wherein the luminescent device is arranged in the apparatus case to illuminate the liquid crystal display device.

9. An electronic apparatus as claimed in claim 8, wherein the luminescent device is arranged under the liquid crystal display device.

10. A luminescent device comprising:

a plate-like luminescent member, a translucent or transparent protrusion member which is disposed on an upper surface of the plate-like luminescent member, a metallic panel which is disposed on an upper surface of the plate-like luminescent member except the protrusion member, and a printed layer or a metallic layer, which is formed on an upper surface of the protrusion member projecting from an upper surface of the metallic panel, except a peripheral side surface of the protrusion member.

11. A method for manufacturing a luminescent device, comprising:

a first step of forming a protrusion on an upper surface of a translucent or transparent panel member;

a second step of providing a masking layer on a peripheral side surface and an upper surface, of the protrusion;

a third step of forming a printed layer on an upper surface of the panel member except on the peripheral side surface and the upper surface of the protrusion which have the provided masking layer;

a fourth step of forming a printed layer on the upper surface of the protrusion, after removing the provided masking layer from the protrusions; and a fifth step of arranging a plate-like luminescent member on a lower surface of the panel member to which the fourth step was carried out, to manufacture the luminescent device.

12. A method for manufacturing a luminescent device, comprising:

a first step of providing a masking layer on a peripheral side surface of a protrusion which is formed on an upper surface of a translucent or transparent panel member;

a second step of forming metallic layers on upper surfaces of the protrusion and of the panel member, except on the peripheral side surface of the protrusion which have the provided masking layer;

a third step of removing the provided masking layer from the protrusions; and a fourth step of arranging a plate-like luminescent member on a lower surface of the panel member to which the third step was carried out, to manufacture the luminescent device.

13. A method for manufacturing a luminescent device, comprising:

a first step of forming a translucent or transparent protrusion member and forming a hole having a shape corresponding to the protrusion member in a metallic panel;

a second step of forming a printed layer or a metallic layer on an upper surface of the protrusion member and forming a decorative layer on an upper surface of the metallic panel;

a third step of setting the protrusion member in the hole of the metallic panel; and a fourth step of arranging the protrusion member and the metallic panel on an upper surface of a plate-like luminescent member, to manufacture the luminescent device.

* * * * *